US007278653B2

(12) United States Patent
Pelka et al.

(10) Patent No.: US 7,278,653 B2
(45) Date of Patent: Oct. 9, 2007

(54) WHEELCHAIR, PARTICULARLY ELECTRIC WHEELCHAIR

(75) Inventors: Joachim Pelka, Amberg (DE); Heinrich Perk, Aglasterhausen (DE); Thomas Brendel, Sinsheim (DE); Andreas Biederstadt, Klausdorf (DE)

(73) Assignee: Otto Bock HealthCare GmbH, Duderstadt (DE)

( * ) Notice: Subject to any disclaimer, the term of this patent is extended or adjusted under 35 U.S.C. 154(b) by 0 days.

(21) Appl. No.: 10/525,048

(22) PCT Filed: Sep. 4, 2003

(86) PCT No.: PCT/DE03/02962

§ 371 (c)(1),
(2), (4) Date: Oct. 25, 2005

(87) PCT Pub. No.: WO2004/030596

PCT Pub. Date: Apr. 15, 2004

(65) Prior Publication Data

US 2006/0138835 A1 Jun. 29, 2006

(30) Foreign Application Priority Data

Sep. 5, 2002 (DE) ..... 102 41 008

(51) Int. Cl.
*A61G 5/04* (2006.01)
*A61G 5/00* (2006.01)

(52) U.S. Cl. ..... 280/650; 280/642; 280/647; 280/47.25; 280/47.38; 280/47.4; 180/907

(58) Field of Classification Search ..... 280/250.1, 280/304.1, DIG. 10, 47.4, 47.41, 47.25, 47.38, 280/47.34, 647, 642, 650; 180/907, 908; 297/DIG. 4; 296/65.03–65.04; D12/131
See application file for complete search history.

(56) References Cited

U.S. PATENT DOCUMENTS

| | | | | |
|---|---|---|---|---|
| 3,285,619 | A | 11/1966 | Kitrell et al. | |
| 3,847,493 | A * | 11/1974 | Peter et al. | 403/370 |
| 3,971,186 | A * | 7/1976 | Havelka et al. | 403/374.4 |
| 4,358,125 | A * | 11/1982 | Charles | 280/250.1 |
| 4,405,142 | A | 9/1983 | Whetstine | |
| 4,730,842 | A * | 3/1988 | Summers et al. | 280/638 |
| 4,824,303 | A * | 4/1989 | Dinger | 411/79 |
| 4,968,050 | A * | 11/1990 | Kendrick et al. | 280/250.1 |
| H000906 | H * | 4/1991 | Baggett et al. | 403/409.1 |
| 5,294,141 | A * | 3/1994 | Mentessi et al. | 280/250.1 |
| 5,360,224 | A * | 11/1994 | Geiger et al. | 280/250.1 |
| 5,421,598 | A * | 6/1995 | Robertson et al. | 280/250.1 |
| 5,480,172 | A * | 1/1996 | James | 280/250.1 |
| 5,584,494 | A * | 12/1996 | Krumm | 280/288.1 |
| 5,743,545 | A | 4/1998 | Kunze et al. | |

(Continued)

FOREIGN PATENT DOCUMENTS

| | | |
|---|---|---|
| DE | G 89 00 500.7 | 1/1989 |
| EP | 0 885 605 A1 | 12/1998 |
| GB | 2 141 980 A | 1/1985 |

*Primary Examiner*—Christopher P. Ellis
*Assistant Examiner*—Vaughn T. Coolman
(74) *Attorney, Agent, or Firm*—Whitham Curtis Christofferson & Cook, PC

(57) ABSTRACT

Disclosed is a wheelchair, particularly an electric wheelchair, comprising a frame (20), at least one steerable wheel (3), two non-steerable wheels (5) which are connected to the frame (20) at a wheelbase (R), and a seat (10) that is fastened to the frame (20) and is provided with a back rest (8). The inventive wheelchair is characterized by the fact that the wheelbase (R) is adjustable.

7 Claims, 2 Drawing Sheets

U.S. PATENT DOCUMENTS 5,782,483 A * 7/1998 Rogers et al. ..... 280/642
5,957,474 A * 9/1999 Mundy et al. ..... 280/304.1
6,308,804 B1 * 10/2001 Roberts ..... 188/2 F
6,447,064 B1 9/2002 Mundy et al.

* cited by examiner

8
H
9'
10
9
7
12
11
6
1
5
2
II
20
A
D
16
4
3
R

WHEELCHAIR, PARTICULARLY ELECTRIC WHEELCHAIR

The invention relates to a wheelchair, particularly an electric wheelchair, having a frame, at least one wheel which is mounted rotatably about an axis of rotation and is steerable, and two non-steerable wheels which are connected in relation to each other to the frame in a wheelbase R, and having a seat which is fastened to the frame and has a backrest.

In the case of these known wheelchairs, the frame has a fixed size which determines the size of the wheelchair. The spectrum of body sizes of the possible wheelchair users means that it is not possible to adapt the center of gravity of the body in respect of the optimum pivotal point of the wheelchair. This means that a very large person sits too far to the rear, with the result that the overall center of gravity is shifted too far to the rear, and a very small person sits too far forward, with an overall center of gravity shifted further forward. The different position of the overall centers of gravity results in the load being distributed unfavorably to the driving or steering wheels, thus limiting the driving performance.

In order to shift the center of gravity, seat systems which can be displaced in the longitudinal direction on fixing elements on the frame are known. However, a system of this type increases the overall length of the wheelchair, thus restricting its ability to turn.

U.S. Pat. No. 4,405,142 discloses a wheelchair in which the steerable front wheels are fastened to a separate front frame. The end tubes of the front frame can be pushed into tubes of the rear frame. Holes which are spaced apart in parallel in the front frame and rear frame and into which bolts can be inserted make it possible to adjust the length of the wheelchair and therefore the wheelbase. This configuration makes it impossible to optimally align the center of gravity because the wheelbase can only be adjusted in stages which are predetermined by the hole spacing. In order for the two frame parts to be connected in a completely fixed manner and for it not to be possible for the front frame to shake, there should not be any play between the hole and bolt. The connection therefore has to take place via fixing pins, which is very complicated structurally. Severe jarrings are caused by the wheelchair traveling on public paths and roads, and traveling over curbs and the like. In order for the fixing connection between the tubes not to be knocked out, there have to be high wall thicknesses and the fixing pin has to have a large diameter, which then means that the tube diameter has to be correspondingly large. The security of sufficient stability is then inevitably paid for by a high frame weight.

Taking this problem as the starting point, the wheelchair explained at the beginning is to be improved, with the above disadvantages being avoided, to the effect that it can be adapted in largely optimum fashion to the user's size.

To solve the problem, a wheelchair of the generic type is distinguished in that the wheelbase can be adjusted in an infinitely variable manner, and in that the distance of the axis of rotation of the steerable wheel and the frame can be adjusted.

The infinitely variable adjustability of the wheelbase permits an exact adaptation to the user's height. The steering wheel rotates optimally about the fork axle if the latter is situated perpendicularly with respect to the driving plane. If the distance between the axis of rotation and the frame can be adjusted, a change in the angle of the fork during the telescoping process can be compensated for, with the result that the perpendicular pivot axis is always maintained.

In order to adjust the wheelbase, the frame is of telescopic design. To this end, preferably at least two concentrically arranged tubes are provided, the relative position of which tubes in relation to one another can be fixed by at least one clamping element.

In particular, it is advantageous if the position of the tubes can be fixed by three clamping elements which can be fastened in relation to one another.

The at least one steerable wheel is preferably mounted in a fork in a manner such that it can rotate about a horizontal axis of rotation, and the fork is connected to one of the tubes in a manner such that it can pivot about a vertical axis.

In order to adjust the distance between the axis of rotation of the wheel and the frame, a plurality of vertically spaced holes is preferably provided at the lower end of the fork, into which holes the wheel axle can alternatively be fitted. As an alternative, the fastening of the wheel axle may also be realized via an elongated slot with clamping, as is known, for example, in the case of racing bicycles.

The position of the seat in relation to the frame can preferably also be adjusted, so that the seat can be optimally adapted in the horizontal plane to the change in the frame length. It can thus be ensured that the distance of the footrests from the steered wheels is sufficiently large that the latter can pivot freely.

The frame is essentially formed by two tubes which run parallel to each other, are each arranged concentrically and are connected to each other via a welded transverse strut and a battery tray screwed on from below. This configuration makes it possible for the rear tubes which are larger in diameter (main tubes) to be rigid and the tubes which are smaller in diameter and are connected in each case to a steered wheel to then form a telescopic front frame.

An exemplary embodiment of the invention will be explained in more detail below with the aid of a drawing, in which.

Figure 1:
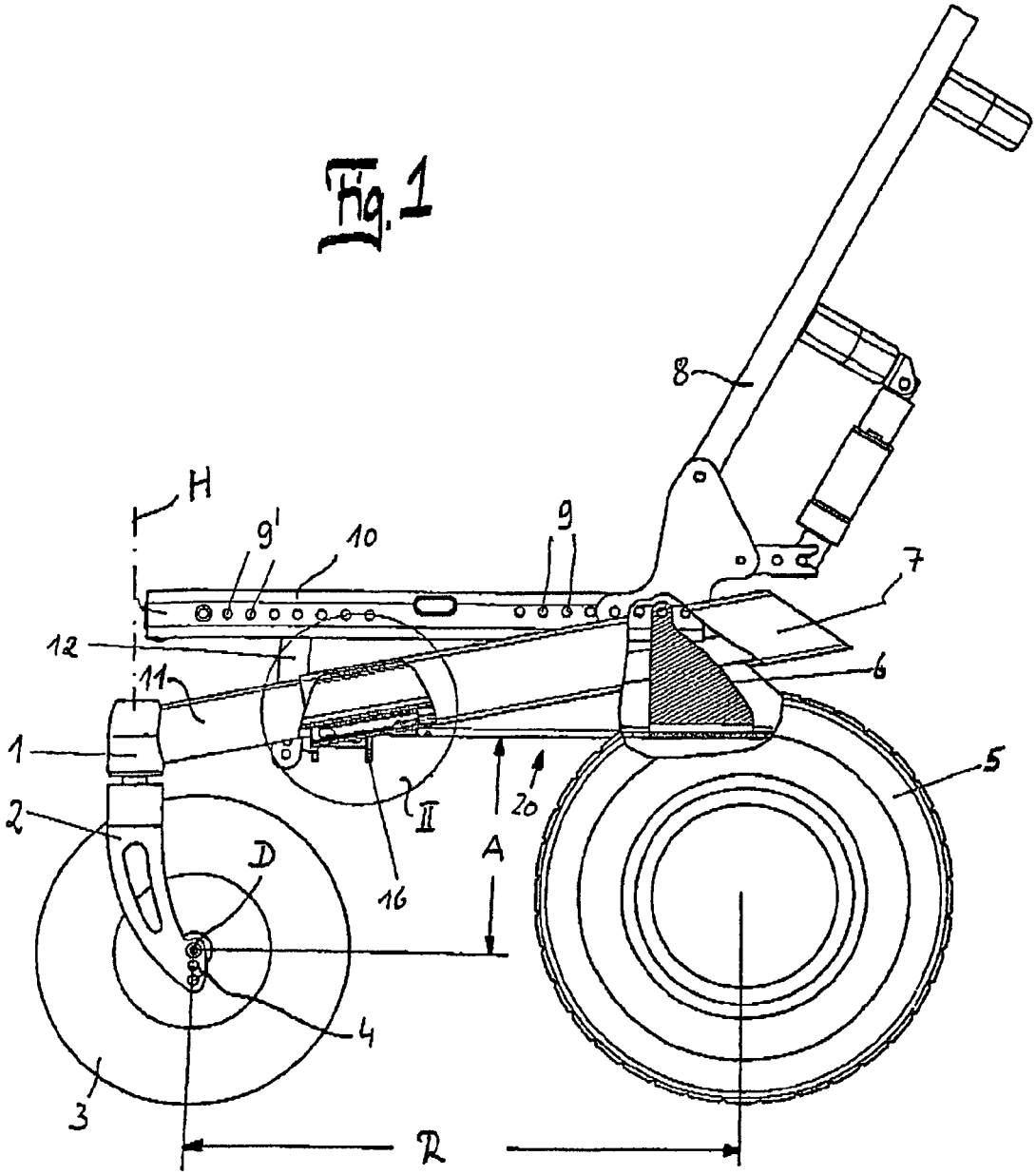
FIG. 1 shows a side view of a wheelchair.
Figure 2:
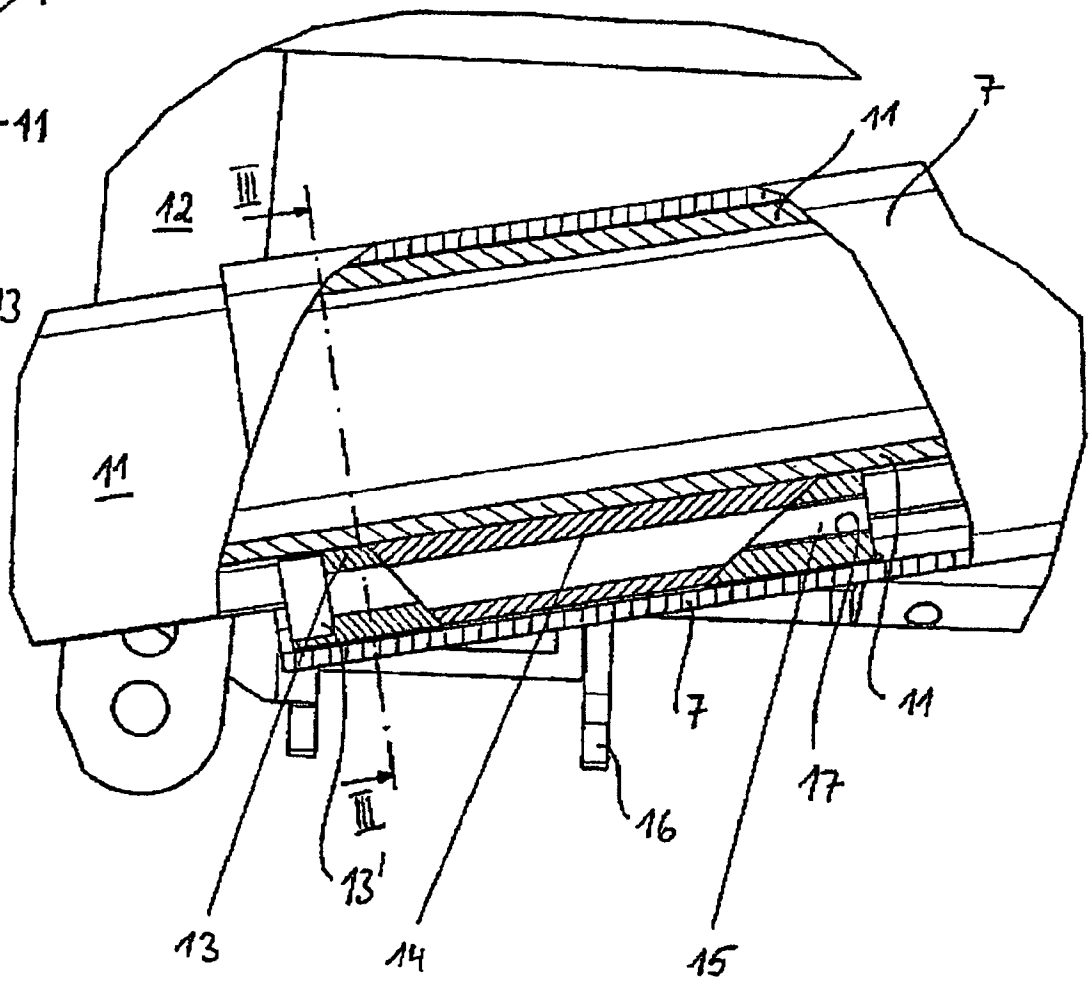
FIG. 2 shows the enlarged detail according to the viewing arrow II from FIG. 1.

The electric wheelchair, the drive units of which are not illustrated specifically here, has a frame 20 on which two steerable front wheels 3 and two driving wheels 5 are arranged spaced apart from one another in the wheelbase R. The frame 20 is essentially formed by tubes 11, 7 which are arranged on both sides, run concentrically and are connected to each other via the seat 10 and adaptation tabs 6, 16.

The front frame, which is formed by the tubes 11, is telescopic. To this end, the tube 11 corresponds in the outside diameter to the inside diameter of the tube 7 and is pushed into the latter.

In a recess, three clamping elements 13, 14, 15 are provided one behind another in the longitudinal direction in the tube 11. The two outer clamping elements 13, 15 are beveled at their inner ends. The central clamping element 14 is beveled congruently at its two ends to the clamping elements 13, 15. The three clamping elements 13, 14, 15 are in each case provided with a passage hole (not referred to specifically here). The passage hole of the inner clamping element 15 is provided with an internal thread 17. The passage hole of the outer clamping element 13 has a stepped hole 13' which serves to receive a screw head (not illustrated specifically here). The clamping elements 13, 14, 15 are fastened to one another via a screw (not illustrated) which is screwed into the thread 17, the bevels causing the central clamping element 14 to be pressed radially outward against the inner wall of the outer tube 7, so that the relative position of the inner tube 11 in relation to the outer tube 7 can be fixed in an infinitely variable manner. It is also conceivable for the tubes 7, 11 to be able to be telescoped in a stepped manner by, for example, holes which are spaced apart in parallel being provided in the walls, being brought to overlap and then a bolt being inserted through them. Other fixing means are also conceivable.

The outer tubes 7 are connected to one another via a welded transverse strut—not illustrated here—and a battery tray which is screwed on from below.

The driving wheels 5 are connected to the rigid tubes 7 via rear adaptation tabs 6. A steering wheel mount 1 is provided at the free ends of the inner tubes 11 and accommodates a fork 2, which can pivot about the vertical axis H and in which the steering wheels 3 are fastened mounted in a manner such that they can rotate about an axis of rotation D. The telescopability of the frame 20 enables the wheelbase R to be adjusted in an infinitely variable manner.

As FIG. 1 shows, the tubes 7, 11 are inclined with respect to the contact area of the wheels 3, 5. If the tubes 7, 11 are telescoped, the angle of the vertical axis H of the fork 2 changes in relation to the perpendicular. The pivotability of the steering wheels 3 is optimum if the vertical axis H coincides as far as possible with the perpendicular. In order to compensate for the change in the angle during the telescoping of the frame 20, a plurality of vertically spaced holes 4 are provided at the lower end of the fork 2, into which holes the wheel axle can alternatively be inserted, so that the distance A between the axis of rotation D of the steering wheel 3 and the frame 20 can be adjusted. Instead of a plurality of holes 4, an elongated hole, in which the axle of the steering wheel 3 can be clamped, could also be provided in the fork 2.

In order to adapt the seat 10 to the individually adjusted wheelbase R, a plurality of horizontally spaced holes 9, 9' is provided in the seat 10, via which the seat can be fastened to the adaptation tabs 6, 16.

Figure 3:
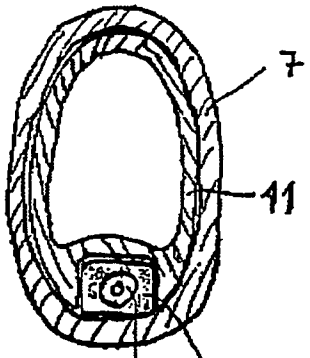
FIG. 3 shows the section along the line III-III from FIG. 2.

The backrest 8 of the seat 10 can be adjusted in angle electrically. As FIG. 3 shows, the tubes 7, 11 are of oval design in cross section, thus resulting in great stability.

LIST OF REFERENCE NUMBERS

1—Steering wheel mount
2—Fork
3—Front wheel/steering wheel
4—Hole
5—Rear wheel/driving wheel
6—Adaptation tab
7—Tube
8—Backrest
9—Hole
9'—Hole
10—Seat
11—Tube
12—Tab
13—Clamping element
13'—Recessed hole
14—Clamping element
15—Clamping element
16—Adaptation tab
17—Thread
20—Frame
A—Distance
D—Axis of rotation
H—Vertical axis
R—Wheelbase

The invention claimed is:

1. A wheelchair, particularly an electric wheelchair, comprising:

a frame including at least one inclined telescopically adjustable member, said inclined telescopically adjustable member inclined upwards in a front-to-back direction, at least one steerable wheel mounted to said inclined telescopically adjustable member by a mounting means, said at least one steerable wheel being rotatable about a horizontal axis of rotation, said mounting means being pivotal about a pivot axis extending relative to said at least one inclined telescopically adjustable member, at least one non-steerable adjustable wheel that is connected to the frame at a wheelbase location, and a seat which is fastened to the frame, wherein the seat has a backrest, wherein the mounting means has means for adjusting the distance between the horizontal axis of rotation and the frame at a respective telescoping of said inclined telescopically adjustable member, to adjust the pivot axis to be substantially vertical.

2. The wheelchair of claim 1, wherein the seat is fastened to the frame by a means for adjusting the position of the seat in relation to the frame.

3. The wheelchair of claim 1, wherein the inclined adjustable member comprises an outer tube having an inner perimeter shape and an inner tube having an outer perimeter shape scaled with respect to with the inner perimeter shape of the outer tube such that the inner tube is telescopically movable with respect to the outer tube, said outer tube, and wherein the inner tube is selectively fixed to the outer tube by at least one clamping element.

4. The wheelchair of claim 3, wherein the at least one steerable wheel is mounted in a fork in a manner to rotate about the horizontal axis of rotation, wherein the fork is connected to one of the inner and outer tubes, and wherein the fork pivots about the pivot axis.

5. The wheelchair of claim 4, wherein the means for adjusting the distance between the horizontal axis of rotation and the frame includes a plurality of vertically spaced holes provided at a lower end of the fork.

6. The wheelchair of claim 3, wherein said clamping element is positioned between said inner tube and said outer tube, and wherein said clamping element comprises a first member having tapered ends, and a second and third member each have a tapered end engaging a tapered end of said first member, and means for compressing said second and third members against said first member.

7. The wheelchair of claim 6, wherein said first, second and third members are tubes.

* * * * *